United States Patent [19]

Nishimura

[11] Patent Number: 4,676,055

[45] Date of Patent: Jun. 30, 1987

[54] DEVICE FOR UNTWISTING THE END OF YARN IN YARN SPLICING APPARATUS

[75] Inventor: Yoshihiro Nishimura, Nagaokakyo, Japan

[73] Assignee: Murata Kikai Kabushiki Kaisha, Kyoto, Japan

[21] Appl. No.: 830,711

[22] Filed: Feb. 18, 1986

[30] Foreign Application Priority Data

Feb. 15, 1985 [JP] Japan ..... 60-29061

[51] Int. Cl.[4] ..... D01H 15/00

[52] U.S. Cl. ..... 57/22; 57/263

[58] Field of Search ..... 57/22, 261, 263

[56] References Cited

U.S. PATENT DOCUMENTS 4,411,128 10/1983 Mima ..... 57/22
4,416,110 11/1983 Mima ..... 57/22
4,439,978 4/1984 Mima ..... 57/22
4,446,687 5/1984 Mima ..... 57/22
4,494,368 1/1985 Mima ..... 57/22
4,549,392 10/1985 Kimura ..... 57/22

*Primary Examiner*—Donald Watkins
*Attorney, Agent, or Firm*—Barnes, Kisselle, Raisch, Choate, Whittemore & Hulbert

[57] ABSTRACT

A device for untwisting the end of a yarn in a pneumatic yarn splicing apparatus comprising a yarn end untwisting nozzle pipe for jetting a compressed air in the direction toward the axis of the pipe so as to cause the yarn end to be untwisted, in which the point at which the yarn is inserted in the opening of the pipe can be determined by a positioning member mounted adjacent the opening.

6 Claims, 13 Drawing Figures

DEVICE FOR UNTWISTING THE END OF YARN IN YARN SPLICING APPARATUS

FIELD OF THE INVENTION AND RELATED ART STATEMENT

This invention relates to a device for untwisting the end of a yarn to be spliced in a yarn splicing apparatus of the type in which the two ends of yarn are joined with each other at their end into a single yarn without forming a knot at the joined point.

Known in the prior art are various types of yarn joining apparatus capable of knotless splicing, besides those knotters in which the joined yarn comes with a knot at its joined point such as a weaver's or fisherman's knot. In some of the conventional machines, which are designed suitable for filament yarns, the effects of a jet of fluid are used for joining in which the two yarn ends are caused to rather randomly entangle with each other at their end. In others, which are more suitable for spun yarns, the ends of the two yarns are subjected to a spiral jet of fluid which causes them to ravel with each other into a twisted joint. In addition, there are joining apparatus in which mechanical procedures are employed in twisting the ends of the two yarns together.

In any joining apparatus, the ends of the yarn to be spliced must first be untwisted into fibers, the smallest yarn constituting units, although an inherent twists of a spun yarn, that is, the number of twists per length varies depending on the kind of the yarn. To obtain a satisfactory joint, it is preferable to have these untwined fiber ends to be fibers straightened into a substantially parallel bundle so that the ends can be twisted together into a joint with sufficient strength and adequate appearance, with the individual fibers of the both joined ends closely intermingled between themselves.

Some splicing machines are equipped with special means to untwist the ends of the yarn to be spliced into a bundle of loosened single fibers by use of the effect of a jet of fluid.

There are two types of so-called spun yarns. The first type is twisted in a right-handed twist, that is, S-twist, while the second type has a left-handed twist, that is, Z-twist. Thus, to untwist the end of a spun yarn, it must be twisted in a direction opposite to that in which the spun yarn is inherently twisted. It follows, in an untwisting device whose operation is based on jets of fluid, that the point of action produced by the fluid jet must be changed according to the type of the yarn. For example, in a splicing apparatus of the type which is incorporated into automatic winders, an adjustment of the untwisting device section to change the point of action of the fluid jet and to select the direction of the fluid jet is required to obtain properly untwisted state, according to the type of the twist. However, since the splicing apparatus is a very complicated machine made of precision parts, such an adjustment normally consists in extremely cumbursome steps. In addition, the untwisting device section merely forms part of the entire mechanism of the splicing apparatus, adjusting this section alone requires a fine tuning in the rest of the various sections for proper operation of the system as a whole, adding another series of procedures.

OBJECT AND SUMMARY OF THE INVENTION

The present invention has been proposed to eliminate the above-mentioned problems. It is an object of the present invention to provide a device for untwisting the end of a yarn in a splicing apparatus in which the point of action of the jet fluid can be shifted by a very simple operation.

The present invention is directed to a device for untwisting the end of a yarn in a splicing apparatus of the type comprising a yarn end untwisting nozzle pipe adapted therein the yarn end inserted through the opening at one end of the pipe, an orifice formed in the wall of the pipe, and a jet means to produce a stream of compressed air in the direction toward the axis of the pipe through the orifice so as to cause the yarn end to untwist in which the point at which the yarn is inserted in the opening of the pipe can be determined by a guide member that is mounted detachably or in such a manner as to permit adjustment of the location of its mounting.

BRIEF DESCRIPTION OF DRAWINGS

FIGS. 8 and 9 shows the second preferred embodiment, in which FIG. 8 shows a front view of the slide plate for locating the end of a yarn of Z-twist and FIG. 9 shows a front view of the slide plate for locating the end of a yarn of S-twist;

DETAILED DESCRIPTION OF PREFERRED EMBODIMENTS

The preferred embodiments of the present invention will be described in detail in conjunction with the accompanying drawings.

Figure 11:
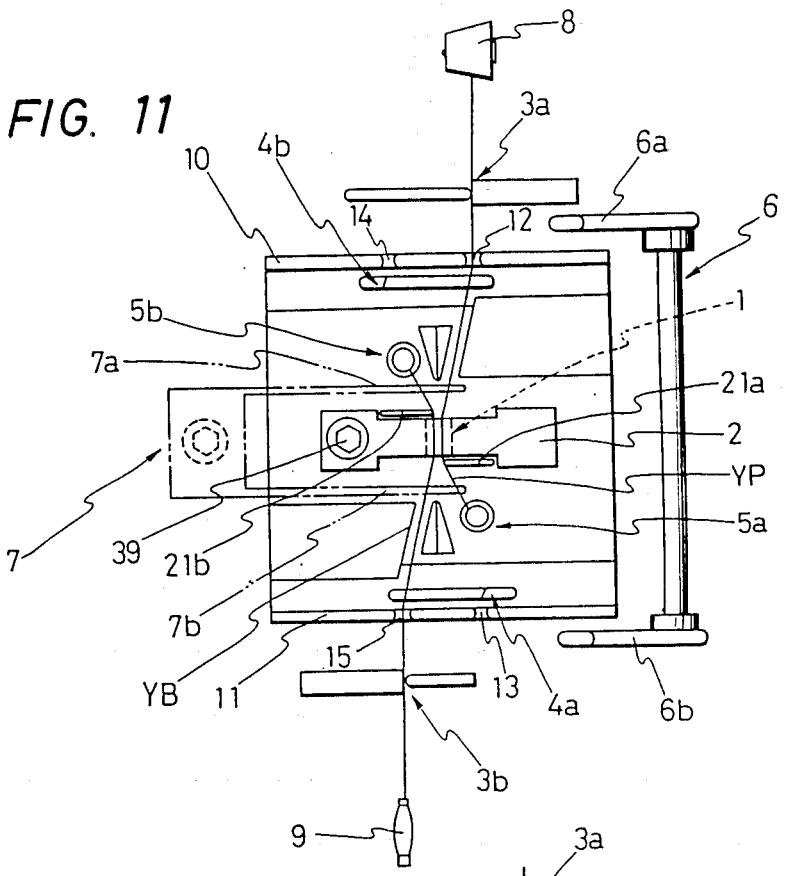
FIG. 11 is a schematic view of the construction of a pneumatic splicing apparatus.
Figure 12:
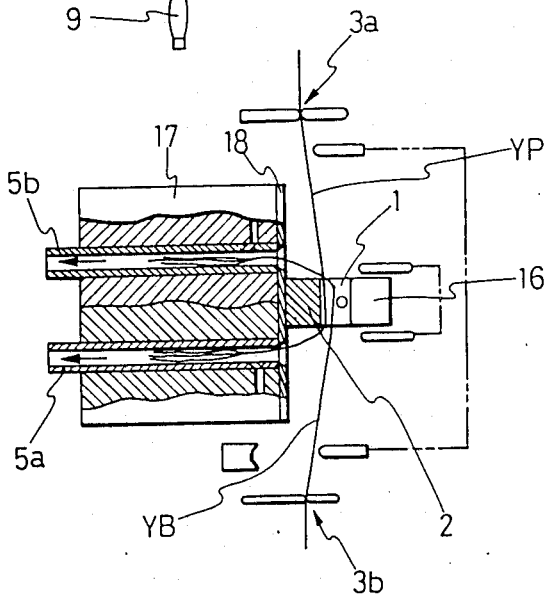
FIG. 12 is a side cross-section view of the same pneumatic splicing apparatus.

FIGS. 11 and 12 are views of an example of a pneumatic yarn splicing apparatus of the type having a device for untwisting the end of a yarn. The apparatus substantially comprises a joining member 2 including a hole 1 in which the ends of the yarns are spliced, a pair of clamps 3*a* and 3*b* provided, each situated at a distance away from the point at which the yarn ends are spliced together, a pair of cutters 4*a* and 4*b* each adapted to cut the end portion of the yarn at a point away from the respective clamp, a pair of untwisting means 5*a* and 5*b* each adapted to untwist the respective end of the yarn when cut by the cutter, a pair of yarn handling levers 6*a* and 6*b*, and a pair of yarn pressing levers 7*a* and 7*b*.

With this arrangement, the upper yarn (YP) from the package 8, along with the lower yarn (YB) to be joined with the upper yarn, is brought over to the joining member 2 by a suitable suction transfer means (not shown) such as a suction mouth or suction pipe. Thereupon, the yarn handling levers 6 are caused to rotate to guide the upper and lower yarns through the guide grooves 12 and 15 or 14 and 13, respectively, formed in the guide plates 10 and 11 to enter the hole 1 through the slit 16 formed in the joining member 2. Simultaneously, the both yarns are pulled toward the clamps 3*a*, 3*b* and the cutters 4*a*, 4*b* on either side of the hole where the yarns, while being held in positions by the clamps 3*a*, 3*b*,are cut by the cutters 4*a*, 4*b* at a point along the their respective end portion, a predetermined distance away from the respective clamp. The upper yarn and the lower yarn, after cutting at their forward end, are then sucked into the untwisting nozzle pipes 5*a*, 5*b* by suction that are mounted adjacent to the yarn running pathes. In the nozzle pipes a jet of compressed air is generated to cause the end of the inserted yarn to untwisted into a bundle of loose fibers. Thereafter, the yarn handling levers 6 are actuated to pull on the yarns withdrawing their untwisted ends from the nozzle pipes 5*a*, 5*b* back into the hole 1 of the joining member 2. The yarn pressing levers 7 are actuated to fix the yarns in positions where their ends are laid side by side within the hole 1. Thereupon, a jet of compressed air is directed into the hole to cause the yarns to entwist each other at their loosened end into a single spliced yarn.

Figure 13:
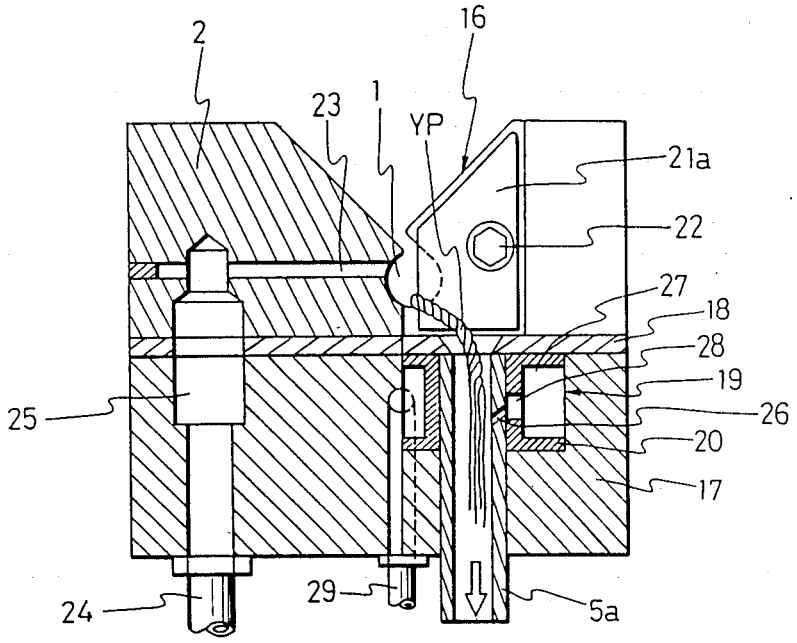
FIG. 13 is a top cross-section view of the same pneumatic splicing apparatus.

FIG. 13 is a cross-section view of the joining member 2 with the nozzle pipe 5*a*. The joining member 2, along with the front plate 18, is detachably mounted on the block 17 through retaining screws. An untwisting nozzle unit 20 is fitted within the space 19 defined in the block 17 and the nozzle pipe 5*a* is provided in the untwisting nozzle unit 20. At each of the open ends of the hole 1 in the joining member 2 are mounted a pair of control plates 21*a* and 21*b* each of which is fixed in such a position by a nut 22 as to cover part of the respective opening of the hole. The control plates are adapted to control the flow of jet air through the hole as well as to locate and limit the yarn end inserted into the hole in proper position for splicing.

The hole 1 is provided with an air jet passage 23 that may be laid to extend along a line tangent to the curve of the inside circumference of the hole. In the joining member 2 is provided a connecting duct 25 that runs through the block 17 and the front plate 18, interconnected for fluidic communication between the air jet passage 23 and a pipe 24 that is laid in communication with a source of compressed air. In the wall of the untwisting nozzle pipe 5*a* is formed an air jet duct 26 that opens into the inside of the nozzle pipe. The air jet duct 26 is inclined at an angle and extends in a direction toward the axis of the nozzle pipe 5*a*. Also, the nozzle unit 20 has therein an air jet duct 27 to which the air jet passage in the nozzle pipe is connected through a passageway 28 for fluidic communication. Also, the air jet duct 27 is communicated to a supply pipe 29 through which compressed air is supplied to the nozzle pipe.

The mechanisms which provides a means of selecting the position at which the end of the yarn to be spliced is held, when it is sucked into the corresponding nozzle pipe 5*a*, 5*b*,according to the type of the inherent twists, as described below.

Figure 1:
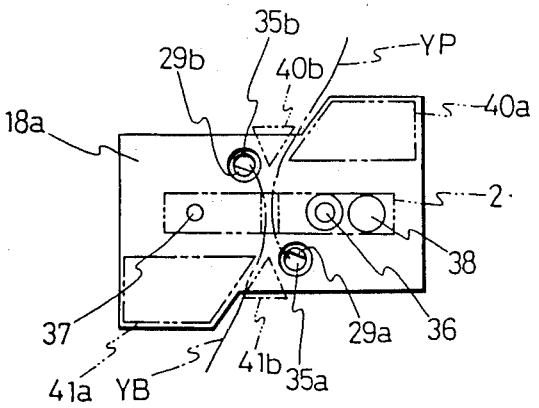
FIGS. 1 and 2 are front views of the first preferred embodiment, illustrating the front plate for yarns of Z-twist in FIG. 1 while the one for yarns of S-twist in FIG. 2.
Figure 2:
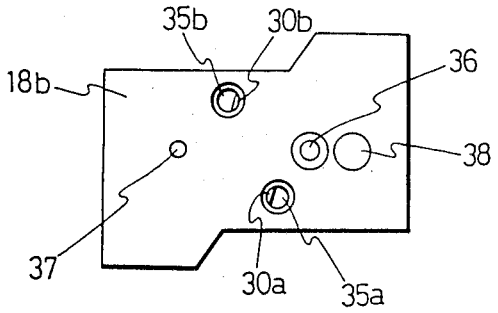
Figure 3:
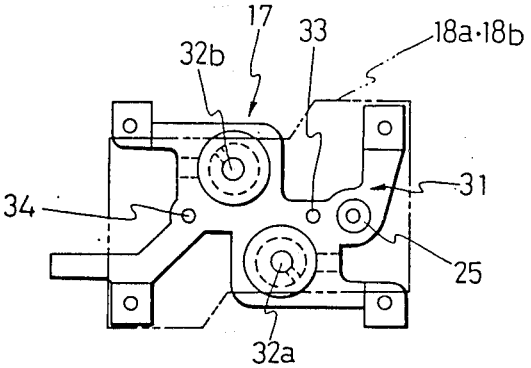
FIG. 3 is a front view of the block on which the front plate is mounted.

FIGS. 1 through 3 are views of a first preferred embodiment of the mechanism which provides a way of changing the position at which the sucked yarn end, is held. A pair of alternate front plates 18*a* and 18*b* are provided for detachably mounting in secured position in the surface of the block 17. The front plates each carry therein paired locating members 29*a*, 29*b* and 30*a*, 30*b* situated in such positions so that, when the selected front plate is mounted in position in the block, its paired locating members cover part of the openings of the untwisting nozzle pipes formed in the block 17. Each of the front plates 18*a* and 18*b* is designed for handling a different type of yarn twist, S-twist, or Z-twist. Thus, in operation, the proper one of them, selected to meet the type of the yarns to be spliced, is mounted on the block 17. In FIG. 3, the block 17 is secured fixedly in the winding unit. In that surface 31 of the block 17 in which the front plate is mounted, there are provided the openings 32*a* and 32*b* of nozzle pipes each for untwisting the end of a yarn. Also, a supply duct 25 is provided which supplies compressed air to the joining member 2. In the same block surface, self-tapping screws 33 and 34 are provided to fix the front plate and the joining member. The supply duct 25 projects a distance from the plane of the front block surface 31 to determine the position of the front plate and the joining member.

The front plate 18*a*, as best shown in FIG. 1, has a pair of circular cutouts 35*a* and 35*b* formed in alignment with the openings of the nozzle pipes, respectively. Also, a pair of locating members 29*a* and 29*b* are mounted in such positions to cover part of the cutouts 35*a* and 35*b* in the front plate. The front plate 18*a* depicted in FIG. 1 is designed for splicing yarns of Z-twist. On the other hand, the front plate shown in FIG. 2 is for yarns of S-twist. Also, each of the front plates 18*a*, 18*b* has therein a pair of cutouts 36 and 37 formed through which the front plate is mounted in position in the block. In addition, in each front plate is formed a cutout 38 through which the supply duct 25 comes out when the front plate is placed on the block. The front plate 18*a* is attached to the block 17 through a bolt inserted through the cutout 36 into screw connection with the tapping screw 33 in the block. Also, the joining member 2 is secured to the block by the bolt 39, as best shown in FIG. 11, that penetrates the joining member 2 to be inserted into screw connection with the tapping screw 34 in the block 17 through the cutout 37.

Referring again to FIG. 1, in the front plate 18*a* are secured fixedly two sets of guide blocks 40*a*, 40*b* and 41*a*, 41*b* for guiding the upper and lower yarn lengths to be spliced, respectively. The upper yarn (YP) is passed between the guide blocks 40*a*, 40*b* and has its forward end inserted into the nozzle pipe 5*a* through the hole 1 by suction. The lower yarn (YB), on the other hand, guided between the guide blocks 41*a*, 41*b*, is pulled into the nozzle pipe 5*b* through the hole 1, also by suction. Each of the guide blocks 40*a* and 41*b* is provided to stand on the respective nozzle pipe opening so that the yarn guided between the paired blocks is not affected by the suction produced by the nozzle pipe on either side of the front plate.

The front plate 18*a* for handling yarns of Z-twist will be described in reference to FIG. 4. Since, in each of the nozzle pipes, the jet of air is directed toward the pipe axis, the path of the jet air, as indicated at 45*a*, 45*b*, divides the cross section of the nozzle pipe opening 32*a*, 32*b* into equal halves 32*a*1, 32*a*2 or 32*b*1, 32*b*2 of a circle. The locating members 29*a*, 29*b* are located almost within the one halves 32*a*2, 32*b*2, respectively, so that the upper yarn length (YP) and lower yarn (YB)

are positioned within the other halves 32a1, 32b1, largely at straight edge portions 42a, 42b of the members. The both yarns, passed through the hole, are bent either at opposite end faces 1a and 1b of the hole 1 or, as shown in FIG. 11, at the control plates 21a, 21b, and caused to enter the nozzle pipes 5a, 5b, respectively, by suction, following the shortest path between the nozzle pipe end and the hole edge at which the yarn is bent. Because of this design, absence of the locating members 29a, 29b makes the yarn ends from the hole to be always located in the same positions in the nozzle pipes, regardless of whether the their twist is S-twist or Z-twist. According to this embodiment, however, the positions of the yarn lengths is determined by the locating members 29a, 29b within the half circles 32a1, 32b1. The angle $\theta$ of the path of the jet with respect to the respective end face 1a, 1b of the joining member is preferably selected at 45°.

Figure 5:
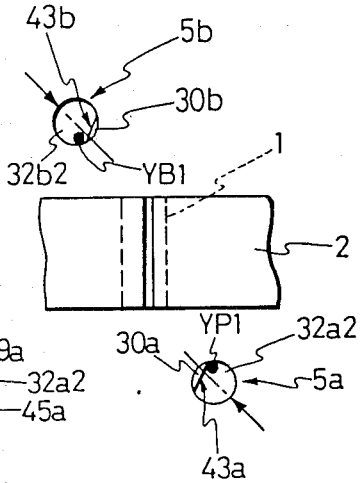
FIG. 5 is also a front view of the front plate showing the location of the end of a yarn of S-twist at the nozzle pipe.

FIG. 5 shows the front plate 18b for yarns of S-twist, designed to provide substantially the same function as the alternative plate, except that the upper and lower yarn lengths to be spliced are guided into the nozzle pipes 5a, 5b through the half circles 32a2, 32b2, not the half circles 32a1, 32b1 intended for yarns of Z-twist. The edge sections 43a, 43b of the corresponding locating members are thus determined to properly guide the yarn ends for proper insertion into the respective nozzle pipes, respectively.

Figure 7:
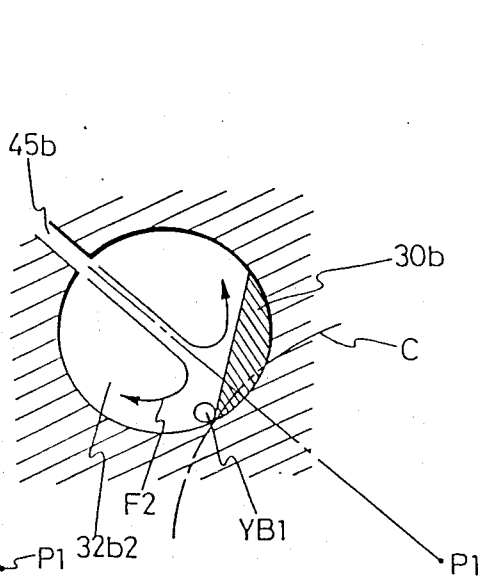
FIG. 7 is an expanded view of the nozzle pipe opening showing the location of the end of a yarn of S-twist.
Figure 6:
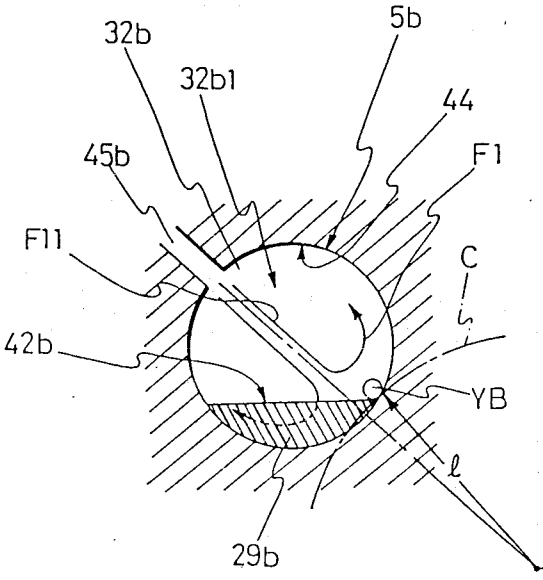
FIG. 6 is an expanded view of the nozzle pipe opening showing the location of the end of a yarn of Z-twist.

This embodiment will be described in further detail in conjunction with FIGS. 6 and 7. Referring first to FIG. 6, which shows the nozzle pipe for untwisting the end of a spun yarn of Z-twists, the opening 32b of the nozzle pipe comprises an arcuate peripheral portion 44 and a chord portion 42b which outlines part of the locating member 29b. With this arrangement, when the lower yarn (YB) hole is pulled into the untwisting nozzle pipe opening by suction, it is compelled to pass the only point, designated at (YB) in FIG. 6, along the priphery of the opened end of the nozzle pipe. This point (YB) lies along the curvature of an imaginary circle (C) described about center P1, the point at which the yarn is bent at the edge of the hole of the joining member, with radius l, the distance between points P1 and (YB). The above principles are also applied to the nozzle pipe for yarns of S-twist shown in FIG. 7, except that the lower yarn (YBl) of S-twist is caused to enter the nozzle pipe opening at point (YBl) through the half circle 32b2. Similarly, the point lies the shortest distance from where the yarn comes out from the hole of the joining member.

With the lower yarn YB located in this position in the nozzle pipe, when the jet orifice 45b produces a jet of compressed air, directed toward the axis of the nozzle pipe and inclined at a angle so that the air is jetted toward the opposite pipe end, the yarn of Z-twist is caused to untwist into a bundle of loose fibers at its forward end, being subjected to the cyclic actions of, on the one hand, a spiral jet F1 that acts to cause the yarn to leave its original position and swirl along the inside circumference of the half circle 32b1 and, on the other hand, a direct air jet F11 that acts to forces it back to the original position. In this manner, the yarn is repeatedly gyrated within the untwisting nozzle pipe in a direction opposite to that of the Z-twist. Similarly, within the nozzle pipe for yarns of S-twist shown in FIG. 7, the lower yarn YBl, when sucked into the untwisting nozzle pipe, is subjected to a spiral jet F2 of compressed air until it is untwisted at the forward end. Thus, the present invention can untwist both Z-twist and S-twist simply be selecting the proper one of the locating members 29b and 30b for the untwisting nozzle pipe, with no need to change the direction of the jet of compressed air.

Figure 10:
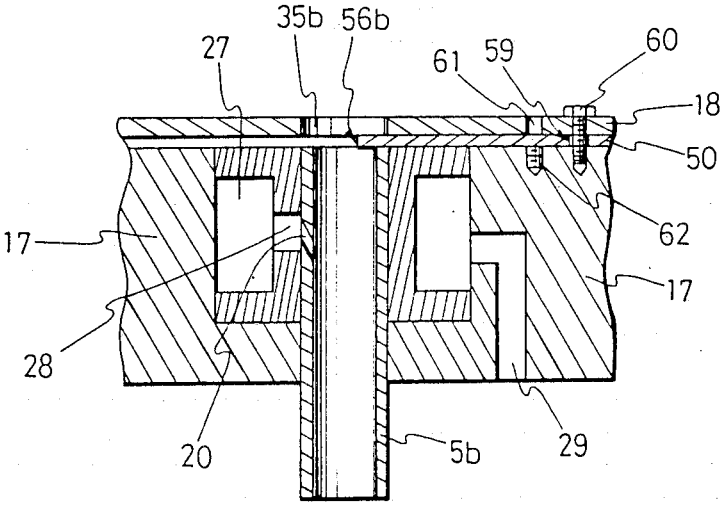
FIG. 10 is a cross-section view of the device showing the relative location of the slide plate to the block and the front plate.
Figure 8:
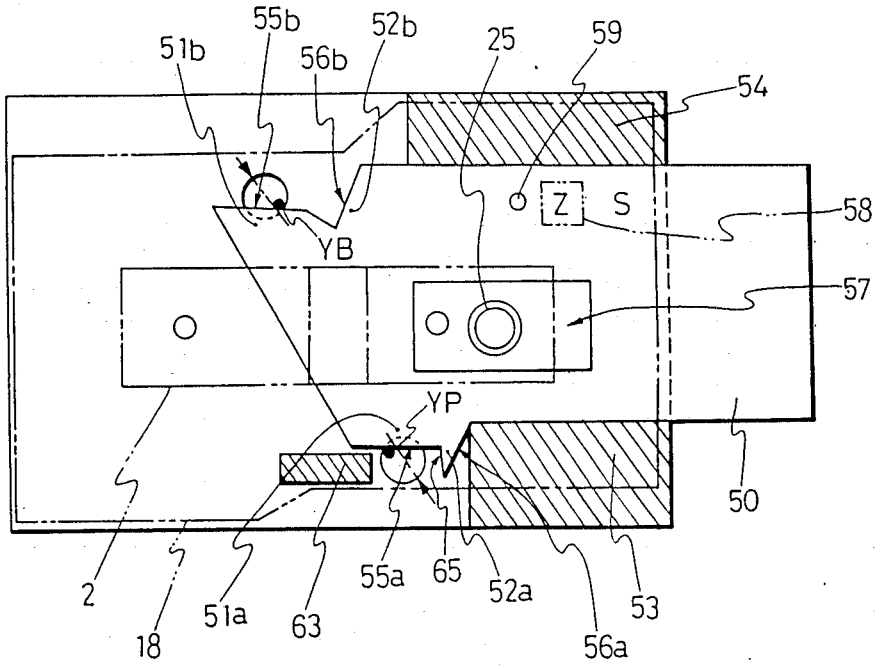
Figure 9:
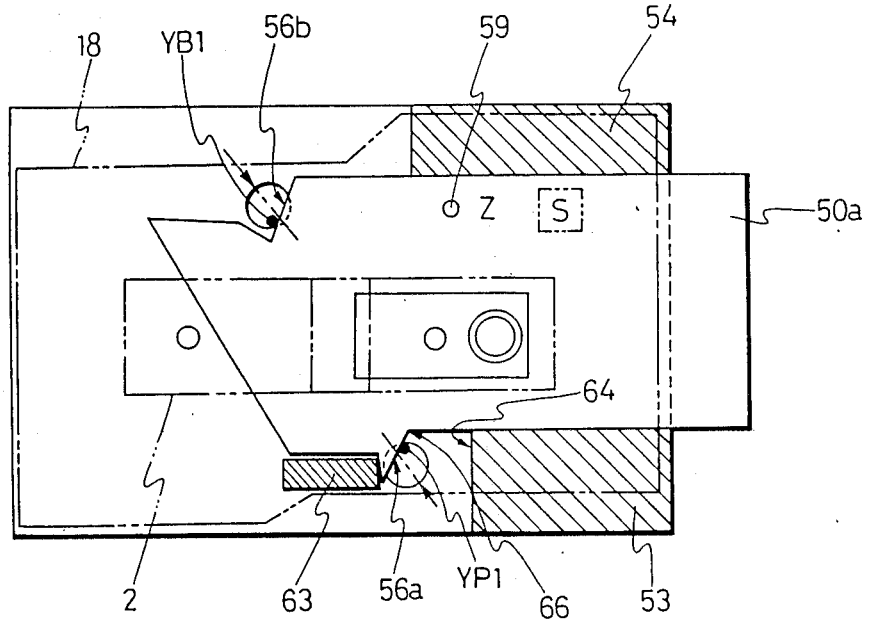

FIGS. 8 through 10 show different views of a second preferred embodiment according to the present invention. A slide plate 50 is provided, which carries therein a first pair of locating members 51a and 51b for locating the yarn of Z-twist and a second pair of locating members 52a and 52b for locating the yarn length of S-twist. Also, the slide plate 50 is slidably disposed for location at alternate two positions, one where the yarn of Z-twist is located and the other where the one of S-twist is located. As shown in FIG. 10, the slide plate 50 is situated between the block 17 and the front plate 18 and, as shown in FIG. 8, is slidable laterally along guide portions 53 and 54. Also, the slide plate 50 has a first pair of locating edges 55a and 55b adapted to locate the yarn of Z-twist in the first position and a second pair of locating edges 56a and 56b formed to locate the yarn of S-twist at the second position. In addition, in the slide plate 50 are provided a supply duct 25 for supplying compressed air and a cutout 57 through which the bolt is passed to secure the front plate. A window 58 is cut in the slide plate, which displays the current position of the slide plate by means of letters "Z" and "S" which indicate the positions for the two types of Z-twist and S-twist, respectively. The slide pate is secured in position by a bolt inserted through a bolt hole 59 formed therein. In FIG. 8, the slide plate 50 is shown in the position indicated by letter "Z" in the window 58. When the slide plate is in this position, a bolt 60 fixes the front plate 18 and the slide plate 50 to the block 17 through the bolt hole 59. Also, in the front plate and the block are formed a bolt hole 60 and a tapping screw hole 62, respectively, through which the bolt 60 is inserted to secure the slide plate in its "S" position. Referring to FIGS. 8 and 9, a pair of stoppers 63 and 64 are provided between the block and front plate to determine the location of the slide plate 50 at each of the foregoing positions. To illustrate, when the slide plate 50 is shifted leftward it is in the "S" position depicted in FIG. 8, with an abutting edge 65 of the plate 50 being abutted against the stopper 63. When the slide plate 50a is moved rightward, on the other hand, it is arrested in the "Z" position depicted in FIG. 9, with an abutting edge 66 of the plate 50a being abutted against the other stopper 64. In this way, the system can be shifted to the desired position, "S" or "Z", in a simple operation. The two pairs of locating members 51a, 51b and 52a, 52b formed in the slide plate 50 are provided for the same function as the locating members in the previous embodiment. Accordingly, the positions of the device shown in FIGS. 8 and 9 correspond to the ones depicted in FIGS. 4 and 5, respectively.

Figure 4:
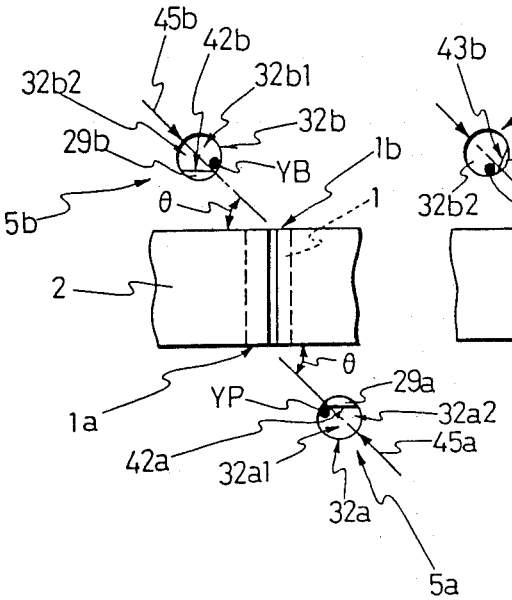
FIG. 4 is a front view of the front plate showing the location of the end of a yarn of Z-twist at the nozzle pipe.

Thus, when the upper yarn (YP) from the package and the lower yarn (YB) from the spinning bobbin are held in positions, the cutters 4a, 4b are actuated so that the cut ends of the upper yarn (YP) and the lower yarn (YB) are sucked into the nozzle pipes 5a, 5b, respectively, and held either in the position of FIG. 4, if they are of the Z-twist, or in the position of FIG. 5, if they are of the S-twist. Thereafter, the sucked yarns are caused to untwist at their forward end under the foregoing effects of the jet of compressed air within the untwisting nozzle pipes.

As stated above, the present invention is capable of untwisting the end of a yarn, regardless of the type of twist, Z-twist or S-twist, within the nozzle pipe into which compressed air is directed for the untwisting, without changing the position of the supply of compressed air. In addition, the locating members, which are adapted to locate the ends of the yarns to be spliced, can be changed in an easy operation to accomodate the type of the yarn to be spliced.

What is claimed is:

1. A device for untwisting the end of a yarn to be spliced in a yarn splicing apparatus comprising an untwisting nozzle pipe adapted to suck therein the yarn end inserted through the opening at one end thereof, said untwisting nozzle having an orifice formed in the wall thereof and a jet means which produces a stream of compressed air jetted in the direction toward the axis of said untwisting nozzle pipe through said orifice to untwist the yarn end, chartacterized in that said device includes a positioning member mounted on the opening adjacent to the yarn end and adapted to set said yarn end at a certain position, said yarn end sucked in the untwisting nozzle pipe being set by means of said positioning member according to the direction of twists of the yarn at the position within one of equal halves of circles which are defined by dividing a cross section of the opening of the untwisting nozzle pipe into two along the path of the compressed air directed toward the axis thereof, and wherein an angle $\theta$ of the path of the yarn with respect to the respective end faces of a yarn joining member of the splicing apparatus is substantially selected at 45°.

2. The device as claimed in claim 1, wherein said front plate is designed for handling a different type of yarn twists, S-twist or Z-twist, respectively.

3. A device for untwisting the end of a yarn to be spliced in a yarn splicing apparatus comprising an untwisting nozzle pipe adapted to suck therein the yarn end inserted through the opening at one end thereof, said untwisting nozzle having an orifice formed in the wall thereof and a jet means which produces a stream of compressed air jetted in the direction toward the axis of said untwisting nozzle pipe through said orifice to untwist the yarn end, characterized in that said device includes a positioning member mounted on the opening adjacent to the yarn end and adapted to set said yarn end at a certain position, said yarn end sucked in the untwisting nozzle pipe being set by means of said positioning member according to the direction of twists of the yarn at the position within one of equal halves of circles which are defined by dividing a cross section of the opening of the untwisting nozzle pipe into two along the path of the compressed air directed toward the axis thereof, and wherein said positioning members are formed on a front plate which is detachably mounted on a block in which the untwisting nozzle pipes are provided, and cover a part of the openings of the untwisting nozzle pipes, respectively.

4. A device for untwisting the end of a yarn to be spliced in a yarn splicing apparatus comprising an untwisting nozzle pipe adapted to suck therein the yarn end inserted through the opening at one end thereof, said untwisting nozzle having an orifice formed in the wall thereof and a jet means which produces a stream of compressed air jetted in the direction toward the axis of said untwisting nozzle pipe through said orifice to untwist the yarn end, characterized in that said device includes a positioning member mounted on the opening adjacent to the yarn end and adapted to set said yarn end at a certain position, said yarn end sucked in the untwisting nozzle pipe being set by means of said positioning member according to the direction of twists of the yarn at the position within one of equal halves of circles which are defined by dividing a cross section of the opening of the untwisting nozzle pipe into two along the path of the compressed air directed toward the axis thereof, and wherein a slide plate is inserted between a block in which the untwisting nozzle pipe is provided and a front plate for covering the block, and said positioning member is formed on said slide plate to cover a part of the opening of the untwisting nozzle pipe.

5. The device as claimed in claim 4, wherein the positioning member for a yarn having S-twist and the positioning member for a yarn having Z-twist are formed on the same slide plate in one body.

6. The device as claimed in claim 5, wherein there are further provided guides for said slide plate, a pair of stoppers provided between the block and the front plate to determine the location of the slide plate to each of S-twist and Z-twist positions, and a means for displaying either S-twist position or Z-twist position.

* * * * *